US006804480B2

(12) United States Patent
Otomo

(10) Patent No.: US 6,804,480 B2
(45) Date of Patent: Oct. 12, 2004

(54) IMAGE FORMING APPARATUS PROVIDED WITH A CLEANING BLADE

(75) Inventor: Yasunao Otomo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/411,108

(22) Filed: Apr. 11, 2003

(65) Prior Publication Data

US 2003/0215254 A1 Nov. 20, 2003

(30) Foreign Application Priority Data

Apr. 12, 2002 (JP) ..... 2002-110113
Mar. 28, 2003 (JP) ..... 2003-090494

(51) Int. Cl.[7] ..... G03G 15/06

(52) U.S. Cl. ..... 399/55; 399/43; 399/45; 399/350; 399/343

(58) Field of Search ..... 399/43, 45, 53, 399/55, 56, 66, 350, 343

(56) References Cited

U.S. PATENT DOCUMENTS 6,014,530 A * 1/2000 Tsunemi ..... 399/53
6,032,005 A * 2/2000 Kyung et al. ..... 399/100
6,163,663 A * 12/2000 Shinohara et al. ..... 399/55

FOREIGN PATENT DOCUMENTS

| | | |
|---|---|---|
| JP | 6-83191 | 3/1994 |
| JP | 10-232521 | 9/1998 |
| JP | 2000-231320 | 8/2000 |

* cited by examiner

*Primary Examiner*—Hoang Ngo
(74) *Attorney, Agent, or Firm*—Fitzpatrick, Cella, Harper & Scinto

(57) ABSTRACT

To provide an image forming apparatus including: an image bearing member; an electrostatic latent image forming means for forming an electrostatic latent image on the image bearing member; a developing means for developing the electrostatic latent image in a development position, the developing means developing the electrostatic latent image using a developer containing a toner and an externally added agent having a charged polarity opposite to that of the toner; a cleaning blade for cleaning the image bearing member; and a bias controlling means for controlling a bias to be applied to the developing means, in which the bias controlling means sets a bias applied to the developing means at the time when an interval area passes the development position according to information related to a length of the interval area at the time when electrostatic latent images for a plurality of pages pass the development position.

12 Claims, 16 Drawing Sheets

APPLICATION SEQUENCE OF DEVELOPMENT BIAS

| | RECORDING MATERIAL LONGITUDINAL WIDTH | RECORDING MATERIAL INTERVAL |
|---|---|---|
| A4 | 297 | 63 |
| A5 | 215 | 145 |
| A4 DUPLEX RECORDING | 297 | 243 |

| CONVENTIONAL EXAMPLE | DEVELOPMENT AC BIAS | | DURABILITY TEST RESULTS (BENDING) | AMOUNT OF TONER CONSUMPTION (g) |
|---|---|---|---|---|
| | ON (mm) | OFF (mm) | | |
| A4 | 297 | 63 | 3000 SHEETS OK | 1000 |
| A5 | 215 | 145 | 2000 SHEETS NG | – |
| A4 DUPLEX RECORDING | 297 | 243 | 1500 SHEETS NG | – |

| FIRST EMBODIMENT | DEVELOPMENT AC BIAS | | DURABILITY TEST RESULTS (BENDING) | AMOUNT OF TONER CONSUMPTION (g) |
|---|---|---|---|---|
| | ON (mm) | OFF (mm) | | |
| A4 | 297 | 63 | 30000 SHEETS OK | 1000 |
| A5 | 360 | 0 | 2000 SHEETS OUT | 600 |
| A4 DUPLEX RECORDING | 540 | 0 | 1500 SHEETS OUT | 1025 |

| SECOND EMBODIMENT | DEVELOPMENT AC BIAS | | DURABILITY TEST RESULTS (BENDING) | AMOUNT OF TONER CONSUMPTION (g) |
|---|---|---|---|---|
| | ON (mm) | OFF (mm) | | |
| A4 | 297 | 63 | 30000 SHEETS OK | 1000 |
| A5 | 300 | 60 | 30000 SHEETS OK | 590 |
| A4 DUPLEX RECORDING | 480 | 60 | 30000 SHEETS OK | 1010 |

FIG. 9

IMAGE FORMING APPARATUS PROVIDED WITH A CLEANING BLADE

BACKGROUND OF THE INVENTION

1. Field of the Invention

The present invention relates to an image forming apparatus such as a copying machine or a printer which uses an electrophotographic recording technique or an electrostatic recording technique, and in particular to an image forming apparatus having a cleaning device for cleaning an image bearing member, which bears a toner image thereon, using a blade.

2. Description of the Related Art

In the known image forming apparatuses that employ a structure in which the following processes are repeated: supplying a toner to an electrostatic latent image electrostatically formed on a surface of a photosensitive drum to form a toner image; and transferring this toner image onto a recording material such as paper, it is difficult to shift the entire toner from the photosensitive drum to the recording material in transferring the toner image, and it is unavoidable that a slight amount of the toner remains on the photosensitive drum. Therefore, it is necessary to sufficiently clean out this residual toner every time the toner image is transferred.

Incidentally, various cleaning device have been so far proposed. Among them, there is a cleaning device adapted to scrape off a residual toner by causing a sharp edge of a cleaning blade, which consists of an elastic material such as urethane rubber, to abut against a surface of a photosensitive drum on a further downstream side than a transfer part thereof (downstream side with respect to a travelling direction of the photosensitive drum). This cleaning device has been widely put to practical use conventionally because, for example, it is simple in structure and small, and is also advantageous in terms of costs.

However, in the cleaning device in the image forming apparatus of the related art described above, it is necessary to cause the photosensitive drum to always carry a small amount of toner in its nip (abutment portion) against the cleaning blade in order to cause the cleaning blade to abut against the photosensitive drum steadily and use this toner as a lubricant, to secure a sliding property of the cleaning blade with respect to the photosensitive drum.

If printing is continued in a state in which the toner as the lubricant is not carried on the surface of the photosensitive drum, the abutment of the cleaning blade against the photosensitive drum not only becomes unsteady (chattering or bending is caused), but the edge of the cleaning blade chips. As a result, a large amount of transfer residual toner or the like on the photosensitive drum slips through the cleaning blade, that is, a cleaning failure occurs.

In particular, in recent years, an amount of toner contained in a process cartridge has been increased due to increase in a life of the process cartridge. In order to improve durability of a photosensitive drum following the increase in the amount of toner, a photosensitive drum is used which is not scraped easily when it rubs against a cleaning blade as compared with the conventional one.

In the case in which a hardness of such a photosensitive drum is high, a frequency of occurrence of a harmful effect such as bending of the cleaning blade increases.

In order to eliminate such a harmful effect, for example, a toner image (solid black or lines) for prevention of bending of a cleaning blade is formed in a non-image area on a photosensitive drum, which corresponds to an interval between two pages at the time when images are printed on a plurality of pages continuously, whereby the bending of the cleaning blade is prevented even if it is low in print durability. In this case, a toner is used as a lubricant between the photosensitive drum and the cleaning blade.

However, the toner image for prevention of bending of the cleaning blade has a disadvantage in that an amount of toner consumption increases to cause increase in costs.

Moreover, in an image forming apparatus in which a transfer roller for transferring a toner image onto a recording material from a photosensitive drum is in abutment against the photosensitive drum, there is a harmful effect in that the toner image for prevention of bending of the photosensitive drum adheres to the transfer roller to make contamination of the transfer roller worse.

SUMMARY OF THE INVENTION

The present invention has been made in view of the above-mentioned problems, and an object thereof is to provide an image forming apparatus which is capable of suppressing a cleaning failure of an image bearing member.

Another object of the present invention is to provide an image forming apparatus which is capable of suppressing bending of a cleaning blade.

Still another object of the present invention is to provide an image forming apparatus which is capable of suppressing an amount of toner consumption.

Still another object of the present invention is to provide an image forming apparatus including:

an image bearing member;

an electrostatic latent image forming means for forming an electrostatic latent image on the image bearing member;

a developing means for developing the electrostatic latent image in a development position, the developing means developing the electrostatic latent image using a developer containing a toner and an externally added agent having a charged polarity opposite to that of the toner;

a cleaning blade for cleaning the image bearing member; and a bias controlling means for controlling a bias to be applied to the developing means, in which the bias controlling means sets a bias applied to the developing means at the time when an interval area passes the development position according to information related to a length of the interval area at the time when electrostatic latent images for a plurality of pages pass the development position.

Other objects of the present invention will be apparent from the following description taken in conjunction with the accompanying drawings, in which like reference characters designate the same or similar parts throughout the figures thereof.

BRIEF DESCRIPTION OF THE DRAWINGS

In the accompanying drawings:

FIG. 9 shows a table illustrating a relationship between a recording material width and a recording material interval and tables illustrating durability test results of the conventional example, the first embodiment, and a second embodiment of the present invention;

DETAILED DESCRIPTION OF THE PREFERRED EMBODIMENTS

First Embodiment

A first embodiment of the present invention will be described with reference to FIGS. 1 to 11.

Figure 1:
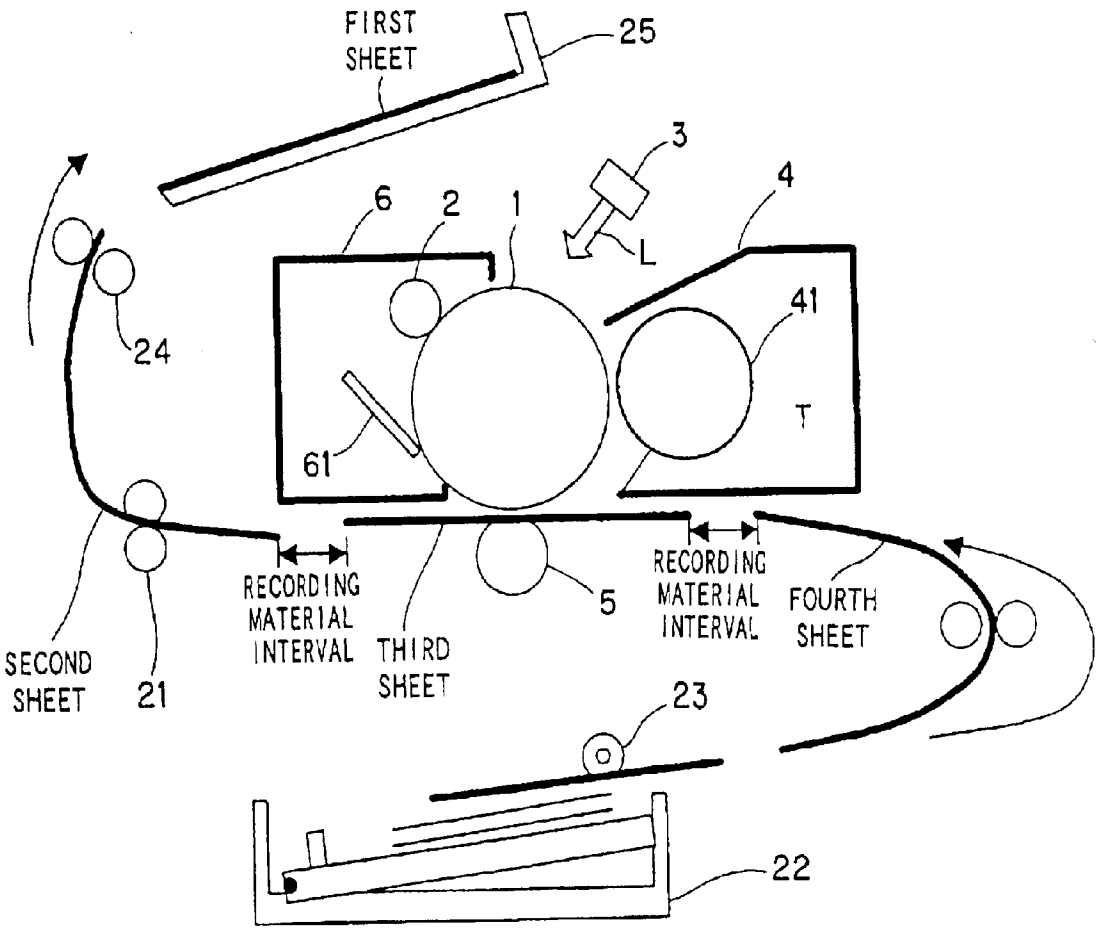
FIG. 1 is a schematic view of an image forming apparatus of a first embodiment of the present invention.

FIG. 1 schematically shows a laser printer of this embodiment. In the figure, reference numeral 1 denotes an electrophotographic photosensitive member of a drum type (hereinafter simply referred to as "photosensitive drum") functioning as an image bearing member. The photosensitive drum 1 is formed of an organic photosensitive body drum.

Around the photosensitive drum 1, a charging member 2 functioning as a charging means, an exposure device 3, a developing device 4 functioning as a developing means, a transfer member 5 functioning as a transferring means, and a cleaning device 6 functioning as cleaning means are arranged in order along a rotation direction of the photosensitive drum 1. Note that reference symbol L denotes a laser beam functioning as exposure light emitted from the exposure device 3.

The charging member 2 has a structure in which a rubber material is molded to a core metal, and applies a bias obtained by superimposing an AC bias on a DC bias to the photosensitive drum 1 to charge a surface thereof to a desired negative potential. In this embodiment, the photosensitive drum 1 is charged to −600 V by setting a DC component to −620 V and an AC component to Vpp=1800 V.

The exposure device 3 turns ON/OFF to irradiate the laser beam L on the photosensitive drum 1 according to image information (image data) and forms an electrostatic latent image on the photosensitive drum 1 by removing charges on the surface of the photosensitive drum 1. In this embodiment, a potential of a part where charges are removed by the laser beam L is approximately −200 V.

The developing device 4 includes a development container and a development sleeve 41, and contains a developer (denoted by T) therein. This developer is a monocomponent developer containing a toner and an externally added agent. The toner of this embodiment is a magnetic toner.

Some toners are easily charged positive and others are easily charged negative (hereinafter referred to as "positive toner" and "negative toner", respectively).

The toner is applied to the development sleeve 41, and a bias obtained by superimposing an AC component (development AC bias) on a DC component (development DC bias) is applied thereto.

From the development sleeve 41, the toner adheres to a part where charges are removed in the case of an image forming apparatus of a system using a negative toner and to a part where charges are not removed in the case of an image forming apparatus of a system using a positive toner.

In this way, development is applied to the electrostatic latent image on the photosensitive drum 1 by the developing device 4 in a development position, and a toner image is formed on the photosensitive drum 1.

Thereafter, charges having a polarity opposite to that of the toner are placed on a back of a recording material, which is picked up by a sheet feed roller 23 from a sheet feed cassette 22 and conveyed toward the photosensitive drum 1, by the transfer member 5 in a transfer position, and the toner image on the photosensitive drum 1 is transferred onto a surface of the recording material by a force of an electric field of the charges. A maximum size of a recording material on which an image can be printed by a printer of this embodiment is A4, and the recording material of the A4 size is conveyed with its longitudinal direction (297 mm) in parallel with its conveyance direction.

The unfixed toner image on this recording material is permanently fixed on the recording material by being heated and pressurized by a fixing roller 21 located further downstream than the transfer position in the conveyance direction of the recording material. Subsequently, the recording material is delivered from the image forming apparatus to a sheet delivery tray 25 through a sheet delivery roller 24.

On the other hand, powder such as a toner or recording material powder remaining on the photosensitive drum 1 at the time of transfer is removed by the cleaning device 6.

A cleaning blade 61 of an elastic blade type is often used in the cleaning device 6.

In this embodiment, the cleaning device 6 of a counter abutment system is adopted which causes an edge of the cleaning blade 61 to abut against the surface of the photosensitive drum 1 such that an abutment direction of the cleaning blade 61 is opposite to a moving direction of the surface of the photosensitive drum 1. With the cleaning device 6 of such a counter abutment system, a transfer residual toner or the like can be collected extremely efficiently.

Note that the photosensitive drum 1, the charging member 2, the developing device 4, and the cleaning device 6 are integrated to constitute a process cartridge. This process cartridge is provided detachably attachable to the image forming apparatus.

Next, a relationship between a recording material length (recording material longitudinal width in this embodiment) and a recording material interval in a recording material conveying direction in the printer of this embodiment will be described.

FIG. 1 is a view of the image forming apparatus at the time when recording materials of A4 are continuously passed (in a state in which images are printed on a plurality of sheets without stopping the photosensitive drum 1). In this case, the recording material interval is small compared with the recording material longitudinal width.

Figure 2:
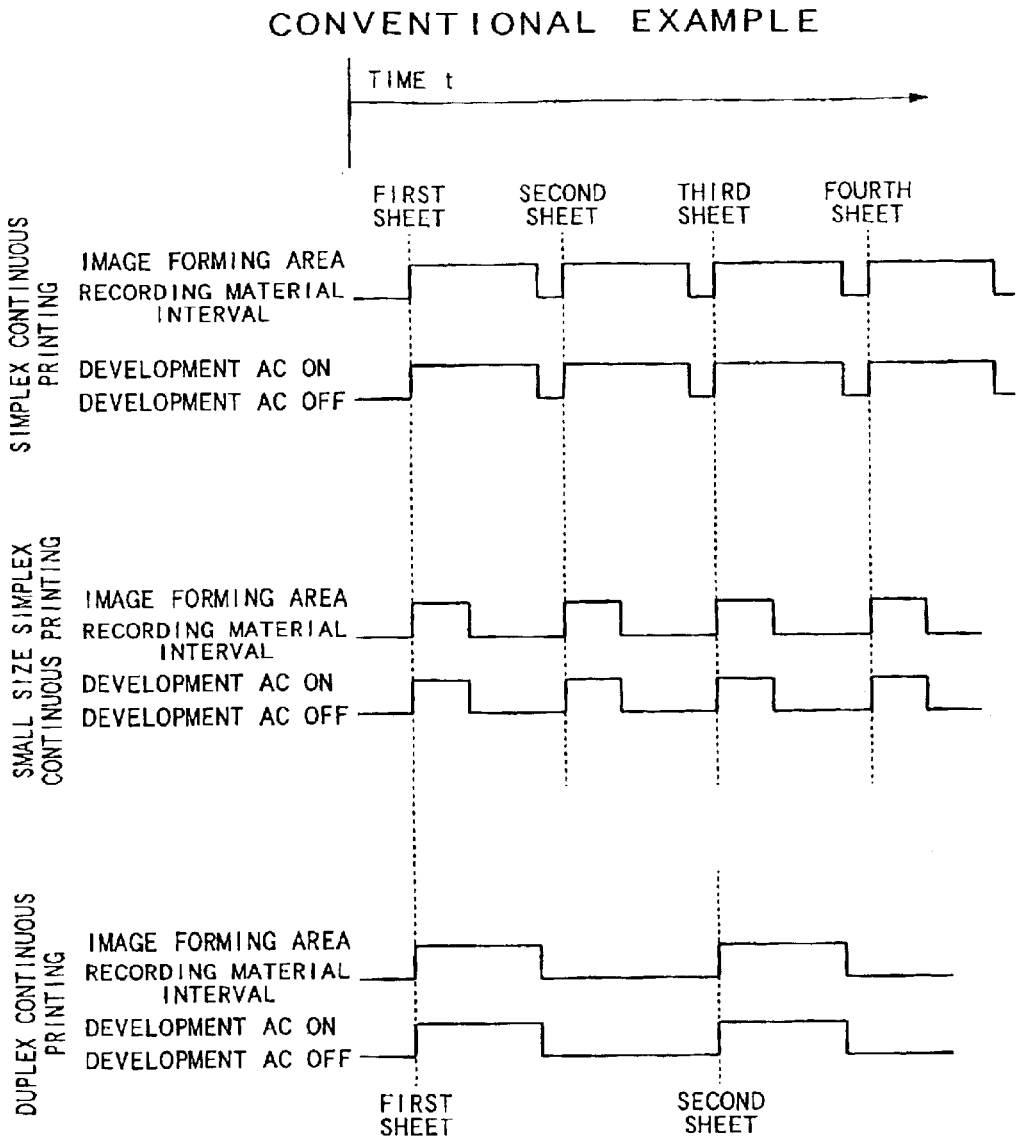
FIG. 2 is a chart showing changes of a development AC bias sequence of a conventional example.

Conventionally, in the case in which recording materials are continuously passed, a development AC bias is turned ON for a time equivalent to a length of the recording material longitudinal width as in FIG. 2. That is, regardless of a recording material size and regardless of whether simplex recording or duplex recording is performed, only a development DC bias is applied and the development AC bias is turned OFF when an area on a photosensitive drum 1 corresponding to a recording material interval (interval area of electrostatic latent images) passes a development position.

However, usually, an interval (recording material interval) at the time when an image is printed on a plurality of recording materials continuously and an interval area of electrostatic latent images on a photosensitive drum 1 corresponding to this interval (the interval area of electrostatic latent images on the photosensitive drum 1 is usually slightly longer than a length of the recording material interval because there is a blank area at a leading edge and a trailing edge of a recording material) are not fixed.

Figure 3:
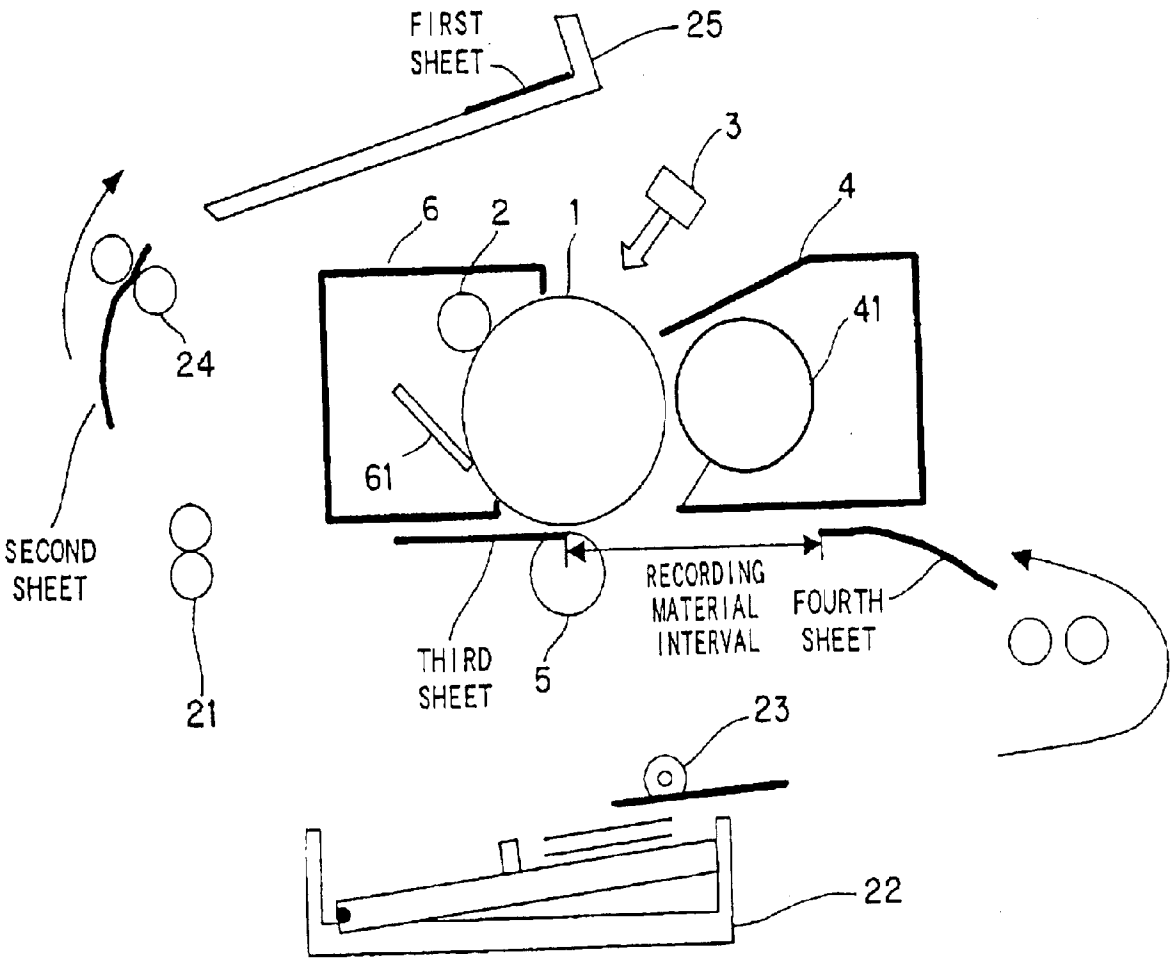
FIG. 3 illustrates a path of recording material at the time of continuous small size printing.

For example, in the case in which recording material having a recording material longitudinal width smaller than a maximum recording material longitudinal width (A4 size in this embodiment) is passed, a recording material interval is set long as shown in FIG. 3 in some devices.

A reason for this is as described below. In order to permanently fix a toner transferred onto a recording material thereon, a general image forming apparatus has a heat-fixing device. In this embodiment, the fixing roller 21 is used. The heat-fixing device is used for heating the toner to be melt and permanently fixing the toner on a recording material. With such a heat-fixing system, when a recording material interval in the case of small size recording material passing is made the same as that in the case of passing recording material of the maximum recording material longitudinal width (A4), a temperature at an end of the fixing roller 21 (outside a recording material lateral width) where the recording material does not pass rises (generally called temperature rise in a non-recording material passing part) and, when printing on large size recording material is performed after printing on the small size recording material, a toner on a part of the recording material corresponding to a non-recording material passing area of the small size recording material is heated excessively to adhere to a surface of the fixing roller 21, that is, a hot offset phenomenon occurs. In order to eliminate such a phenomenon, in the case in which images are printed on small size recording material continuously, the temperature rise in a non-recording material passing part is suppressed by setting a recording material interval long in advance.

Figure 4:
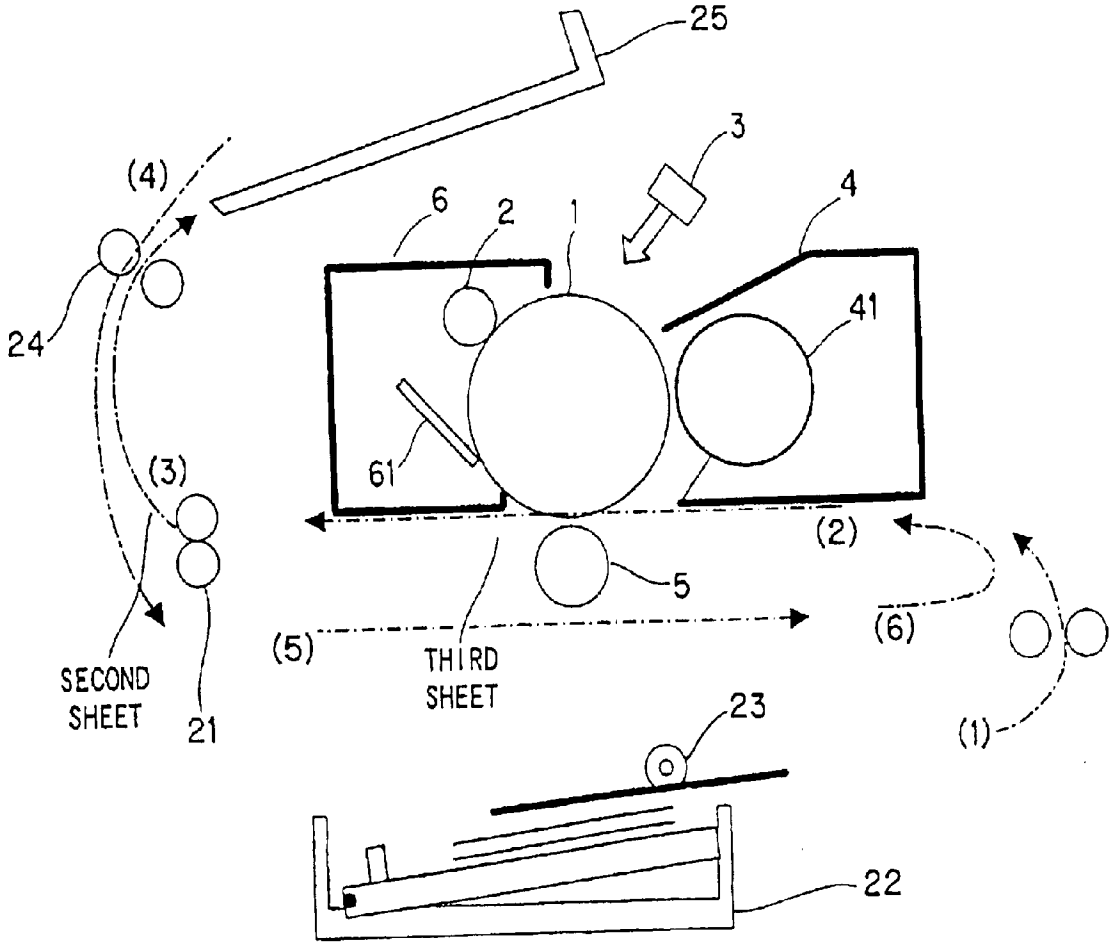
FIG. 4 illustrates a path of recording material at the time of continuous duplex printing.
Figure 5:
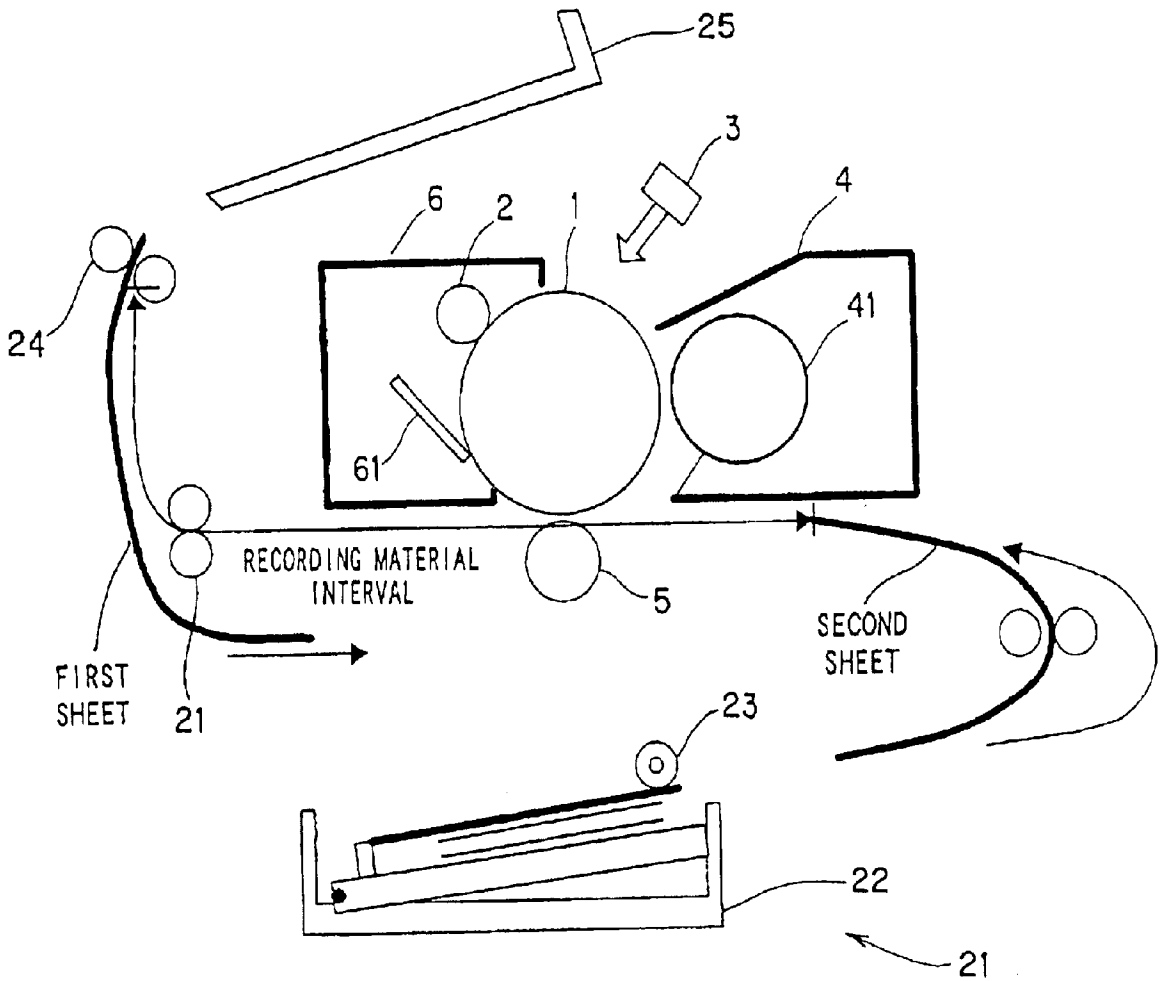
FIG. 5 illustrates a path of recording material at the time of continuous duplex printing.

In addition, as an example in which an interval becomes long, there is the case in which duplex printing is performed. An example of the duplex printing is shown in FIGS. 4 and 5. In this example, after a recording material has reached the sheet delivery roller 24, the recording material is switched back to reverse the front and the back thereof.

As shown in FIG. 4, the duplex printing is the same as a normal simplex continuous printing in that, after recording material is fed from the sheet feed cassette 22 by the sheet feed roller 23, the recording material follows a path from (1) to (2) and (3). However, after passing the fixing roller 21 to reach the sheet delivery roller 24, the recording material follows a path of (4), (5), and (6) and returns to (2), and is reversed to have an image printed on its back.

In the case of this duplex printing, as shown in FIG. 5, a recording material interval enlarges, and the area to which the development AC bias is not applied in the conventional example shown in FIG. 2 also enlarges.

Note that, in this example, a diameter of the photosensitive drum 1 is 30 mm, and a diameter of a transfer roller functioning as the transfer member 5 is 14 mm. Therefore, a circumference of the photosensitive drum 1 is approximately 95 mm, and a circumference of the transfer member 5 is approximately 50 mm.

In this way, the interval varies according to a difference of a size of a recording material, on which an image is printed, or a print mode, and is not fixed.

In the case in which an interval area on the photosensitive drum 1 is short, bending of the cleaning blade 61 does not occur. However, in the case in which the interval area is long, it is likely that an amount of toner in an area where the cleaning blade 61 abuts against the photosensitive drum 1 runs short, and bending of the cleaning blade 61 occurs.

Thus, in this embodiment, "a bias applied to developing means at the time when an interval area passes a development position" is set according to "information related to a length of the interval area at the time when electrostatic latent images for a plurality of pages pass the development position".

In this embodiment, as information for judging a length of an interval area between two electrostatic latent images on the photosensitive drum 1, information on a length of an interval at the time when a plurality of recording materials pass a transfer position and printing mode information on whether simplex printing or duplex printing is performed are used.

Further, in the case in which the interval at the time when the plurality of recording materials pass the transfer position is shorter than a reference length, the bias at the time when the interval area between the two electrostatic latent images passes the development position is set such that a toner and an externally added agent do not adhere to the photosensitive drum 1. In the case in which the interval is longer than the reference length, the bias at the time when the interval area between the two electrostatic latent images passes the development position is set such that the externally added agent adheres to the photosensitive drum 1.

In the case in which the interval area is long, since a bending phenomenon of the cleaning blade 61 tends to occur, the externally added agent is adhered to this interval area, whereby the externally added agent is used as a lubricant for an abutment part of the cleaning blade 61 and the photosensitive drum 1 to prevent bending of the cleaning blade 61.

As the externally added agent for the developer, one having a polarity opposite to a charged polarity of the toner is used in order to adhere the externally added agent to the interval area without adhering the toner thereto by applying an AC bias at the time when the interval area passes the development position.

Figure 6:
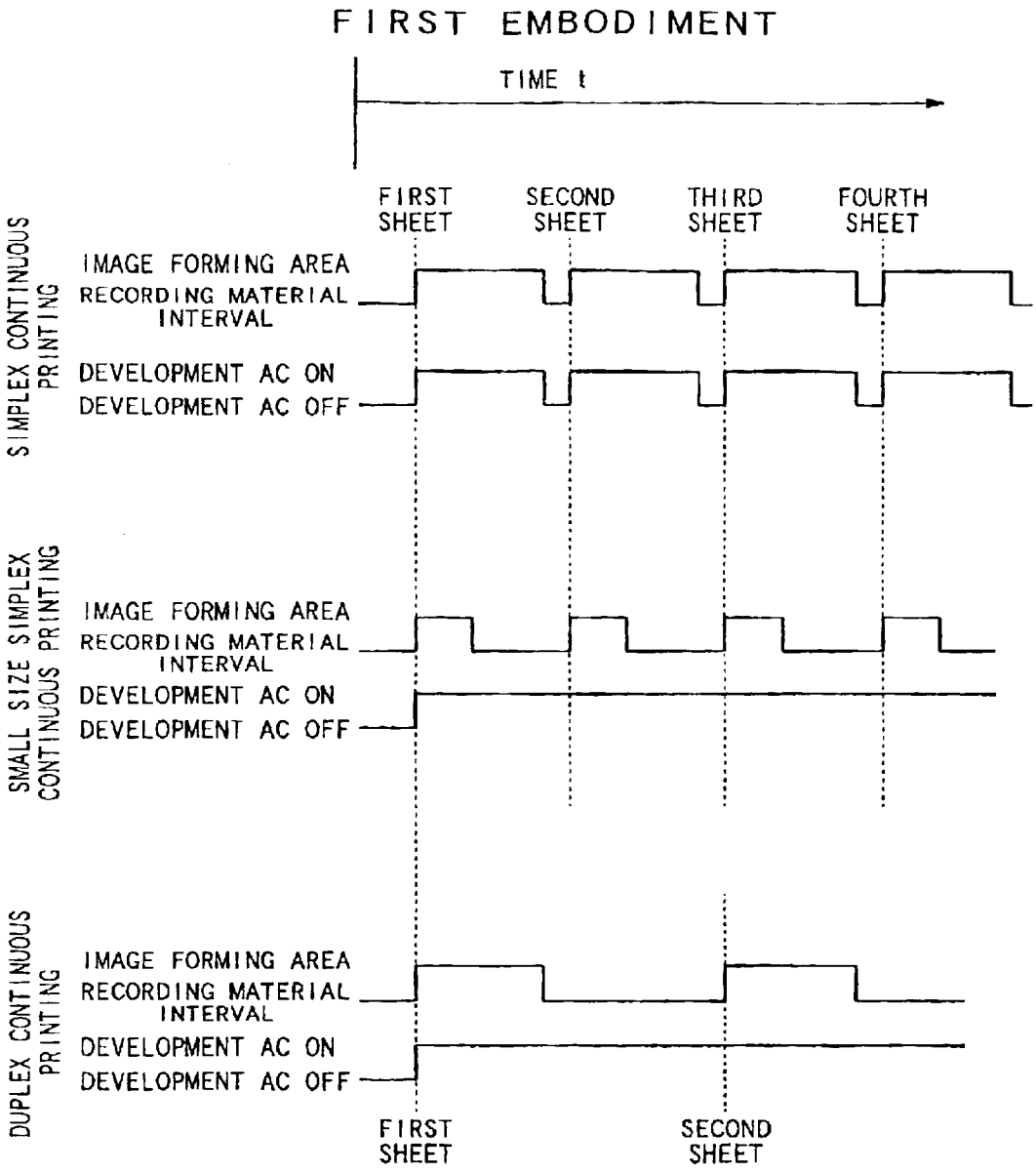
FIG. 6 is a chart showing changes of a development AC bias sequence of the first embodiment.
Figure 7:
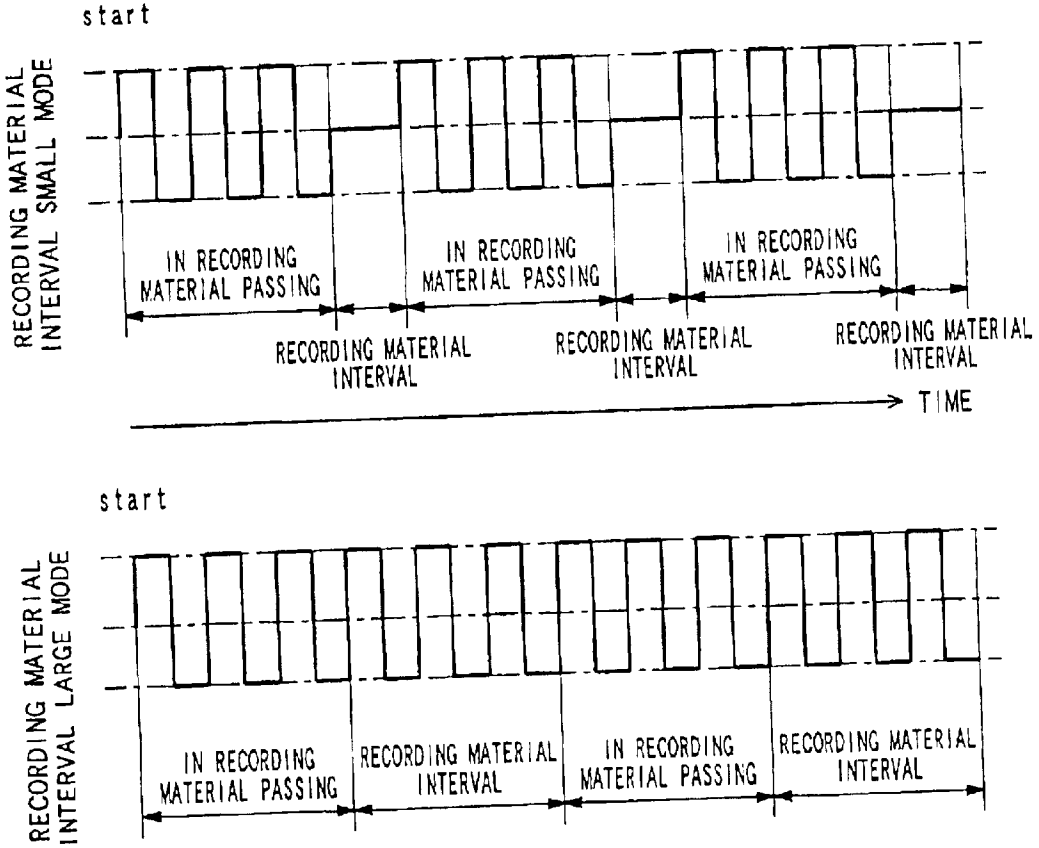
FIG. 7 is a chart showing an actual development bias in the first embodiment.

FIG. 6 shows a relationship between recording material passing timing of a recording material and application timing of an AC bias. FIG. 7 shows an actual applied bias. As shown in FIG. 7, in the case in which the interval is short, only a DC bias (−350 V) is applied and, in the case in which the interval is long, a superimposed bias of a DC component (−350 V) and an AC component (Vpp=1600 V) is applied. Note that the photosensitive drum 1 is charged to −600 V by the charging member 2 both in an electrostatic latent image forming area and an interval area.

In addition, a characteristic required of the externally added agent is not only a charged polarity. It is preferable to use an externally added agent which has a hardness higher than that of a surface layer of the photosensitive drum 1. The reason for this is described below.

First, the photosensitive drum 1 used in the image forming apparatus of this embodiment will be described.

Easiness of scraping of the photosensitive drum 1 correlates a hardness of a drum and can be represented by a Universal hardness.

The photosensitive drum 1 used in this embodiment has a Universal hardness (Hu) of 235. In addition, other photosensitive drums can also be applied to this embodiment.

The Universal hardness (Hu) was measured using a hardness meter (H100VP-HCU) manufactured by Fischer Instruments (GB) Ltd. of Germany. This will be hereinafter referred to as the Fischer hardness meter. A measurement environment was 23° C./55% RH for all cases. The Fischer hardness meter adopts a method of continuously applying a load to an indenter and directly reading an indentation depth under the load to find a hardness continuously rather than a method of indenting an indenter into a surface of a sample and measuring a residual hollow after removing a load with a microscope to find a harness as in the conventional Micro-Vickers method.

The Universal hardness (Hu) is regulated as described below. As the indenter, a diamond indenter (Vickers indenter) with a confrontation angle (136°) of a tip of a pyramid is used to measure an indentation depth under a test load. The Universal hardness (Hu) is indicated by a ratio found by dividing a test load by a surface area of impression (calculated from a geometric shape of an indenter) caused by the test load, and is represented by the following expression (1).

$$Hu=(\text{Test load } (N))/(\text{Surface area of a Vickers indenter under a test load } (\text{mm}^2))=F/(26.43\times h^2)\ (N/\text{mm}^2) \qquad \text{expression (1)}$$

where:

Hu is a Universal hardness ($N/mm^2$);

F is a test load (N); and h is an indentation depth under the test load (mm).

Figure 8:
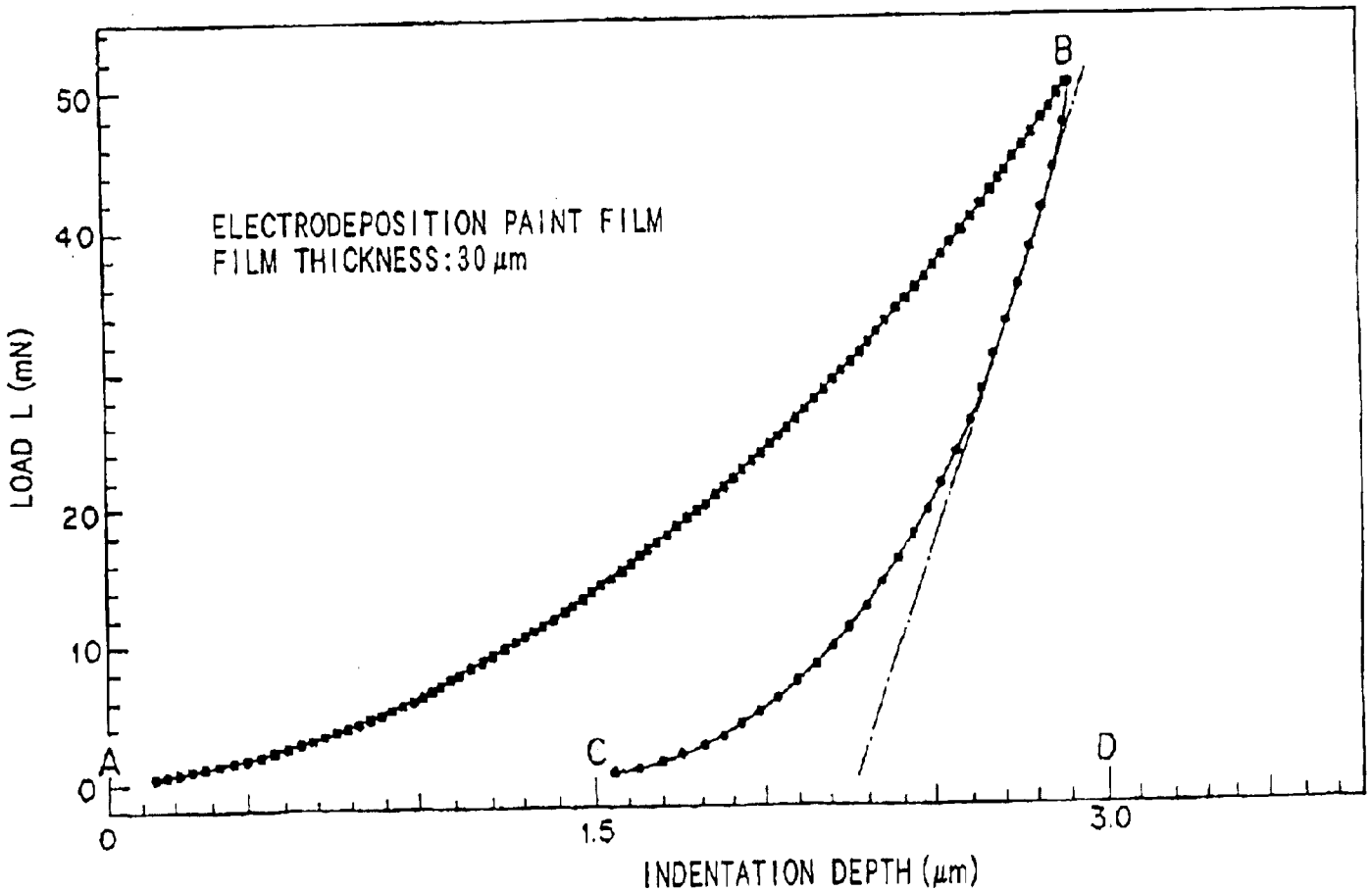
FIG. 8 is a measurement chart according to a Fischer hardness meter.

As measurement conditions of the hardness meter, the hardness meter is indented into a film to be measured to a depth of 1 $\mu$m by applying a load with the diamond indenter with the confrontation angle 136° at the tip of the pyramid, and electrically detects and reads an indentation depth in a loaded state. An example of measurement with the hardness meter is shown in FIG. 8. In the figure, the lateral axis indicates an indentation depth of 3 ($\mu$m) and the longitudinal axis indicates a load L (mN). The load L and the indentation depth obtained here are substituted in expression (1) to find a Universal hardness.

As described above, if the externally added agent has the charged polarity opposite to the charged polarity of the toner, it is possible to adhere the externally added agent in the interval area where the toner does not adhere to the photosensitive drum 1 and use the externally added agent as a lubricant for the abutment part of the cleaning blade 61 and the photosensitive drum 1.

In addition, when the photosensitive drum 1 is charged by a charging member 2, an electric discharge product adheres to the surface of the photosensitive drum 1. It was found that, when the electric discharge product was adhered, a coefficient of friction of the surface of the photosensitive drum 1 increased, and the bending phenomenon of the cleaning blade 61 tended to occur.

Thus, if the hardness of the externally added agent is higher than the hardness of the surface layer (in this embodiment, charge transportation layer) of the photosensitive drum 1, the electric discharge product adhered to the surface of the photosensitive drum 1 can be scraped off by the externally added agent together with the surface layer of the photosensitive drum 1 to decrease the coefficient of friction of the surface of the photosensitive drum 1. Therefore, it is preferable that the externally added agent has the charged polarity opposite to the charged polarity of the toner and the hardness of the externally added agent is higher than the hardness (Universal hardness) of the surface of the photosensitive drum 1.

Next, results of examination for comparing the first embodiment of the present invention and the conventional example and effects of this embodiment will be described.

In a system in which a development AC bias was applied only to an electrostatic latent image area for one page which was formed according to image information (area including blank parts at a leading edge and a trailing edge of a recording material), that is, an area having a length which was the same as a length of the recording material as in the conventional example, a problem arose in that the cleaning blade 61 bent or was damaged by printing of 3000 or less sheets in the case of the small size recording material printing (FIG. 3) or the duplex printing (FIGS. 4 and 5).

Thus, the inventor clarified through experiments and examination that an externally added agent included in a developer preferably had, as characteristics required of the externally added agent, at least a charged polarity opposite to that of a toner, more preferably had characteristics of (1) flying to a VD part of the photosensitive drum 1, (2) having a charging property opposite to that of the toner, (3) having a particulate diameter smaller than that of the toner, and (4) having a hardness higher than that of the photosensitive drum 1.

More specifically, this externally added agent is an inorganic fine powder and has a function of scraping off a low electric resistance material such as recording material powder and a toner adhered to the surface of the photosensitive drum 1. In addition, it also has an effect of assisting charging of a developer.

The inorganic fine powder preferably has a weight average diameter of 0.1 to 5.0 $\mu$m, preferably 0.5 to 5.0 $\mu$m, and more preferably 1.0 to 5.0 $\mu$m in a primary particle (a particle in a state in which the inorganic fine powder has been divided into individual unit particles) or a secondary particle (a particle in a state in which primary particles have cohered).

When the weight average diameter of the inorganic fine powder exceeds the above-mentioned range, the inorganic fine powder is not used for development to remain in the developing device 4 and accumulates to cause degradation of an image. When the weight average diameter becomes smaller than the above-mentioned range, a grinding effect of the inorganic fine powder decreases or cleaning failure occurs to cause degradation of an image.

Examples of the inorganic fine powder used in this embodiment includes metal oxides such as magnesium oxide, aluminum oxide, titanium oxide, iron oxide, zirconium oxide, and cerium oxide, and compound metal oxides such as titanic acid calcium, titanic acid magnesium, strontium titanate, and barium titanate.

Among them, aluminum oxide, cerium oxide, titanium oxide, strontium titanate, magnesium titanate, carbides such as silicon carbide and titanium carbide, and nitrides such as silicon nitride and germanium nitride are often used.

As described before, this material flies to the VD (−600 V) part of the photosensitive drum 1 when the AC bias is applied. Thus, a correlation between a development AC bias application time and easiness of bending of the cleaning blade 61 in a non-recording material passing area was investigated.

Results in a system in which strontium titanate is used as the inorganic fine powder will be hereinafter described based upon FIG. 9. FIG. 9 shows results of a durability test of the cleaning blade 61 at the time when a predetermined image was continuously formed on a plurality of recording materials without stopping the photosensitive drum 1. Note that an amount of toner consumption at that time was also checked.

A recording material interval is 63 mm and 145 mm for A4 recording material simplex printing (longitudinal recording material passing width 297 mm) and A5 recording material simplex printing (longitudinal recording material passing width 215 mm), respectively. In such a case, the cleaning blade 61 never bends even if A4 recording material with a short recording material interval is continuously passed in the conventional example. However, when A5 recording material is passed, the cleaning blade 61 bends when images are printed on 2000 or less sheets. In addition, even if A4 recording material is passed, a recording material interval becomes longer (243 mm) in the case of duplex printing, and the cleaning blade 61 bends with continuous printing of approximately 1500 sheets.

When a reason for this was traced, it was made clear that, since OFF time of a development AC bias became longer (equivalent to a time for one or more rotations of the photosensitive drum 1) in association with a length of a recording material interval, a toner or an externally added agent was not supplied to the photosensitive drum 1, and a lubricant between the photosensitive drum 1 and the cleaning blade 61 was depleted.

Thus, as shown in FIGS. 6 and 7, the inventor tested bending durability in a state in which not only the development DC bias but also the development AC bias was continuously applied even at a recording material interval. In the case of the first embodiment, as shown in FIG. 9, it was found that bending never occurred even in a durability test with A5 recording material and an effect of dramatic bending preventive measures was realized.

This is because, by also supplying an externally added agent to an interval area (area with a potential of −600 V) on the photosensitive drum 1 where an electrostatic latent image is not formed, the externally added agent always exists between the photosensitive drum 1 and the cleaning blade 61, and this externally added agent functions as a lubricant.

In addition, as described in the section of the related art, since bending of the cleaning blade 61 is prevented utilizing an externally added agent having a charged polarity opposite to that of a toner in this embodiment, there is an advantage in that contamination of the transfer member 5 is markedly less compared with a bending prevention method of developing a toner image for bending prevention (solid black or lines) on a photosensitive drum in a non-image area. Note that, although a DC bias of a positive polarity is applied to a transfer member when a toner image on a photosensitive drum is transferred onto a recording material, application of a bias to the transfer member is blocked when a recording material is not in a transfer position at the time of continuous printing or duplex printing regardless of a length of an interval. As a result, adhesion of an externally added agent to the transfer member can also be suppressed.

Based upon the above-mentioned results of examination, in this embodiment, a reference length for judging whether or not an AC bias is applied in an interval area on a photosensitive drum 1 is set to a length of one rotation of a photosensitive drum 1. In the case in which a recording material interval is equivalent to a length of one rotation (95 mm) or more of the photosensitive drum 1 (in continuous printing of a recording material of every size or duplex printing), as shown in FIG. 6, OFF time of a development AC bias at the time when a non-image forming area (interval area) corresponding to the recording material interval passes a development position is eliminated.

Figure 10:
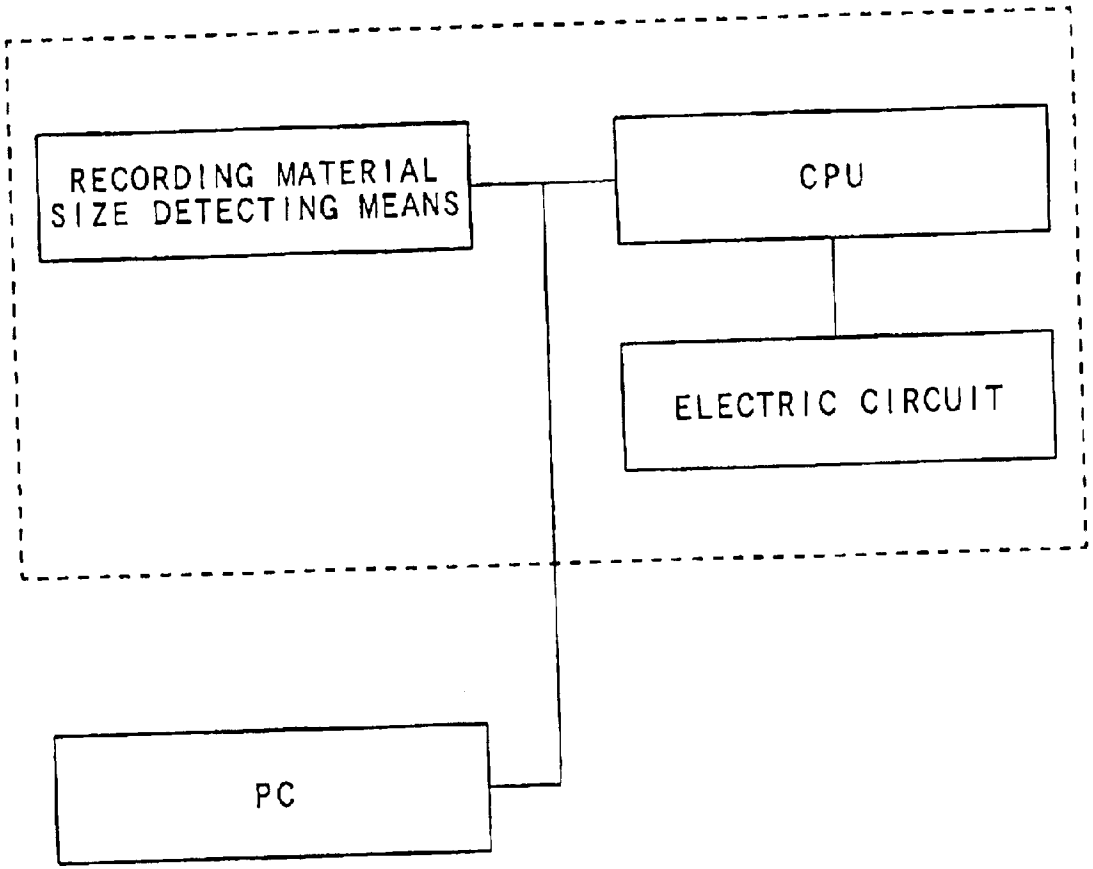
FIG. 10 is a block diagram of the first embodiment.

Next, a block diagram for changing a development AC bias sequence of this embodiment will be described based upon FIG. 10.

First, the image forming apparatus includes a recording material size detecting means, a CPU which can acquire information detected by the recording material size detecting means and make a judgment on a recording material size, and an electric circuit which is ordered by the CPU to change a development AC bias sequence. Moreover, the CPU can acquire information on whether or not printing is continuous printing, whether or not printing is duplex printing, or the like, from a PC and make a judgment on printing.

Figure 11:
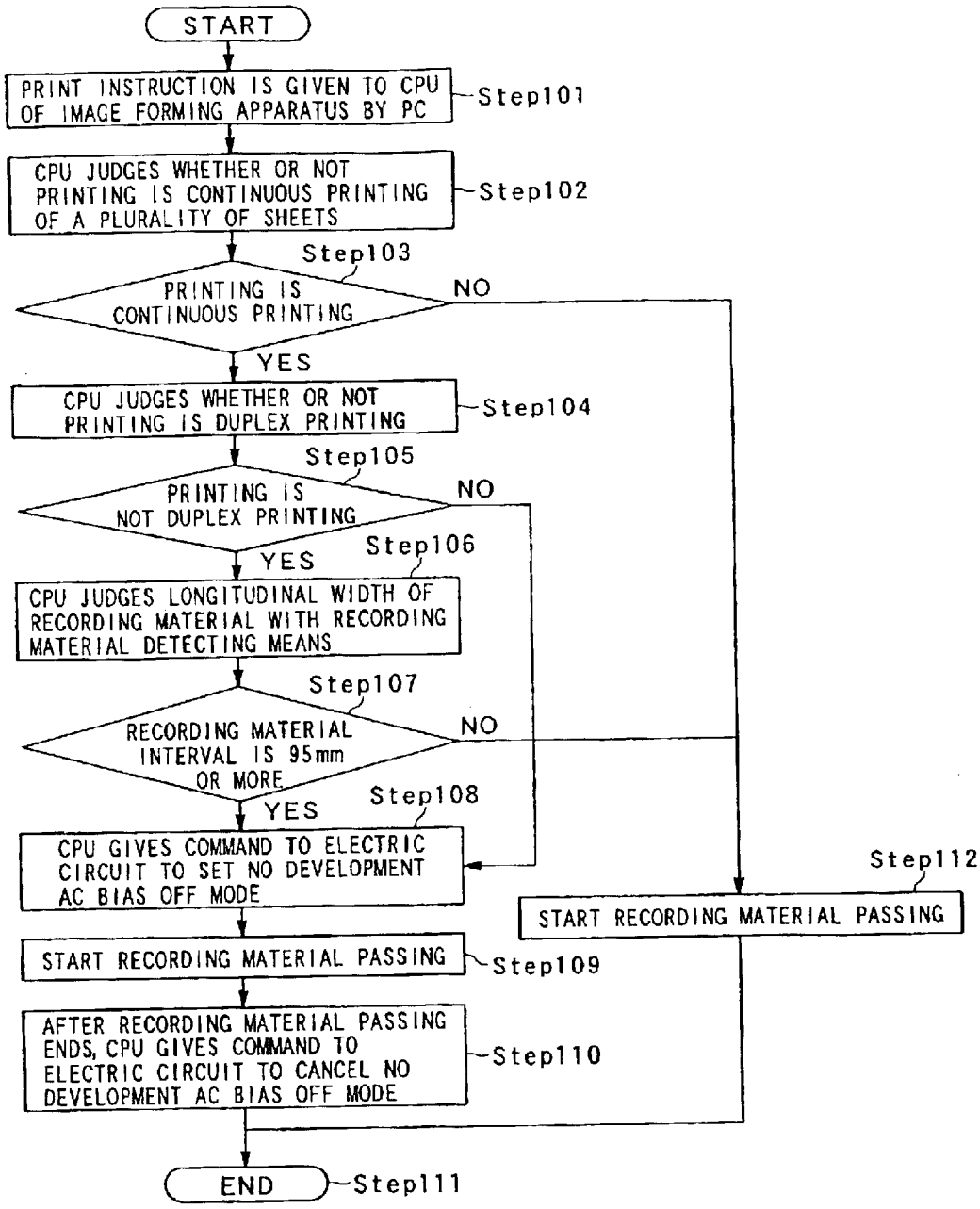
FIG. 11 is a sequence chart of the first embodiment.

Next, a development AC bias change sequence of this embodiment will be described based upon FIG. 11.

First, a print instruction is given to the CPU, which is disposed in the image forming apparatus, by the PC (step 101).

According to information from the PC, the CPU judges whether or not printing is continuous printing of a plurality of sheets (step 102).

The CPU judges whether or not the printing is continuous printing (step 103) and, if it is judged that the printing is continuous printing, the procedure proceeds to step 104. If it is judged that the printing is not continuous printing, the CPU starts recording material passing (step 112), and then, ends the sequence (step 111).

In step 104, the CPU judges whether or not the printing is duplex printing.

The CPU judges whether or not the printing is duplex printing (step 105) and, if it is judged that the printing is duplex printing, the procedure proceeds to step 108. If it is judged that the printing is not duplex printing, the procedure proceeds to step 106.

In step 106, the CPU judges a longitudinal width of recording material with the recording material size detecting means and further judges a recording material interval in the case in which recording material is passed continuously.

The CPU judges whether or not the recording material interval is 95 mm or more (step 107) and, when the recording material interval is less than 95 mm, starts recording material passing (step 112) and ends the sequence (step 111). On the other hand, when the recording material interval is 95 mm or more, the procedure proceeds to step 108.

In step 108, the CPU gives a command to an electric circuit to set a no development AC bias OFF mode (control of FIG. 6).

In step 109, the CPU starts recording material passing.

In step 110, after the recording material passing ends, the CPU gives a command to the electric circuit to cancel the no development AC bias OFF mode.

In step 111, the CPU ends the sequence.

In addition, in this embodiment, in the case in which an interval area on the photosensitive drum 1 abuts against the transfer member 5, a DC bias of the transfer member 5 is brought to a more positive polarity side than the potential (−600 V) of the photosensitive drum 1, whereby adhesion of an externally added agent (positive polarity) and a reversal toner (positive polarity) to the transfer member 5 is prevented, and soiling on the back of recording material due to contamination of the transfer member 5 is prevented. In this embodiment, the DC bias applied to the transfer member 5 is turned OFF.

Moreover, the development DC bias (350 V), the charging DC bias (−620 V), and the charging AC bias (1800 V) are fixed throughout the image forming area and the non-image forming area.

According to this embodiment, an image forming apparatus can be provided which is capable of preventing image failure caused by cleaning failure (mainly bending or chipping) inexpensively and preventing soiling on the back of recording material caused by the transfer member 5.

Second Embodiment

In the first embodiment, in the case in which an interval area is long, an AC bias is applied to the interval area when it passes a development position in the same manner as an AC bias is applied to an image area. On the other hand, in a second embodiment, in the case in which an interval area is long, instead of continuously applying an AC bias to the interval area on a photosensitive member when it passes a development position, time band is provided during which application of the AC bias is temporarily turned OFF in an AC bias application period.

Note that, in this embodiment, the same components as described in the first embodiment will not be described again and will be denoted by the same reference numerals.

Only the first embodiment is sufficient as bending preventive measures. However, if an amount of toner consumption is checked, it is found that, in the case in which a development AC bias is kept ON, an amount of toner consumption is slightly larger than that of the case in which the development AC bias is temporarily turned OFF in this embodiment (FIG. 9).

In addition, there is little more soiling on the back of recording material in the case in which the development AC bias is kept ON. Thus, an experiment was conducted to find a correlation between a travel distance and an amount of fog on the back of recording material at the time of turning development bias OFF in continuous recording material passing in order to reduce the amount of toner consumption as much as possible and eliminate the soiling on the back of recording material.

Figure 12:
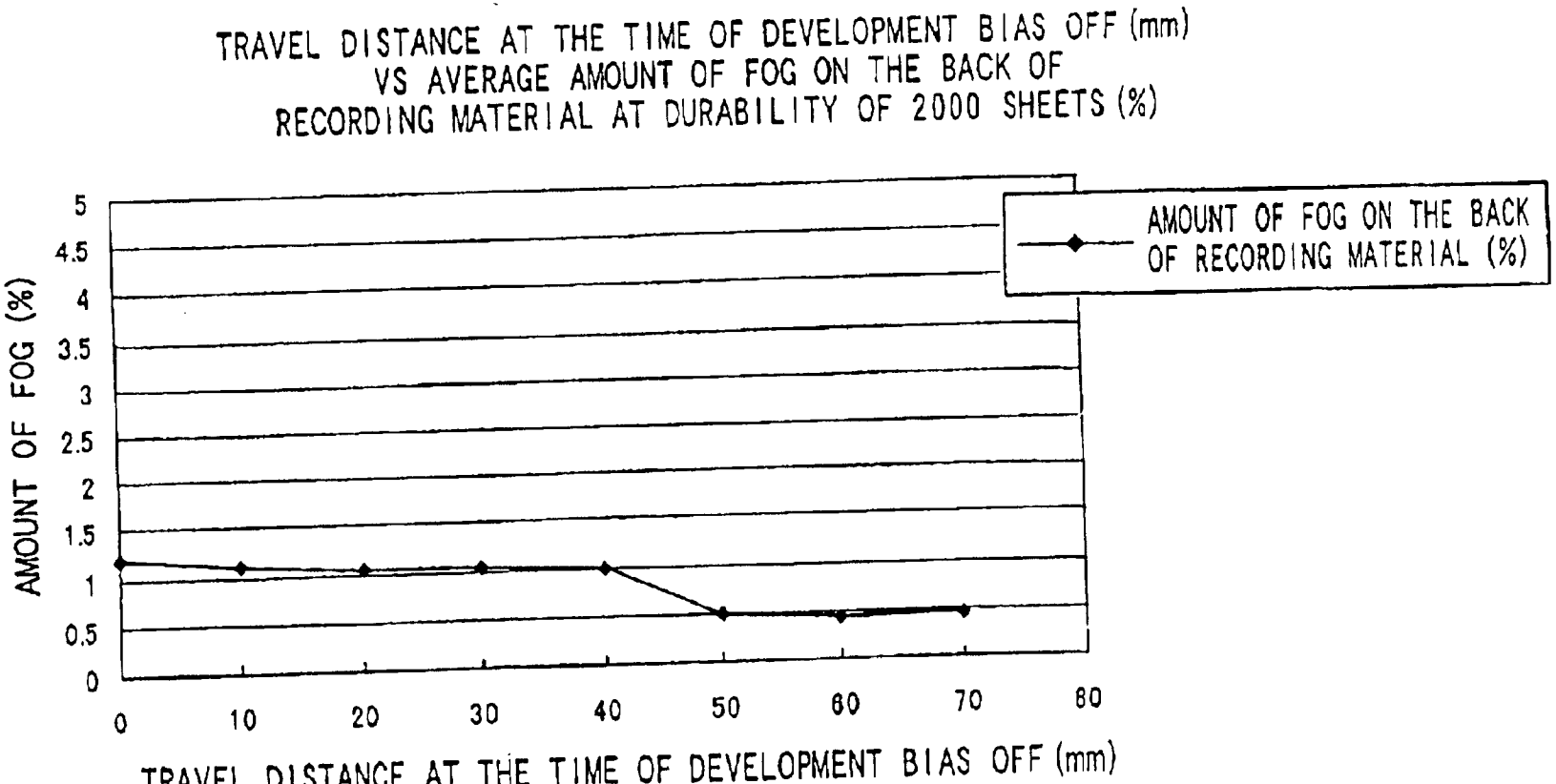
FIG. 12 is a graph showing a travel distance at the time of development AC bias OFF and an average amount of fog on the back of recording material upon a durability test of 1000 sheets.

Then, a result as shown in FIG. 12 was obtained. From this result, it is seen that the fog on the back of recording material suddenly decreases from the vicinity of the travel distance of 50 mm. The travel distance of 50 mm is close to a travel distance for one rotation of the transfer member 5 (a diameter of a transfer roller serving as the transfer member 5 of this embodiment is 14 mm) Thus, even if the development AC bias is applied to the interval area on the photosensitive drum 1, by providing a development AC bias OFF area equal to or larger than one rotation of the transfer member 5 before an electrostatic latent image on the next page reaches a development position, it becomes possible to discharge soiling of the transfer member 5 before that to the photosensitive drum 1 and prevent soiling on the back of recording material.

This also has a sufficient effect as bending preventive measures because the cleaning blade 61 never cleans the photosensitive drum 1 on which an externally added agent does not exist (the development AC bias non-application part is never cleaned twice or more continuously). Incidentally, it was also found that the amount of toner consumption also decreases by 5 to 10 g compared with the case in which the development AC bias is kept ON.

Figure 13:
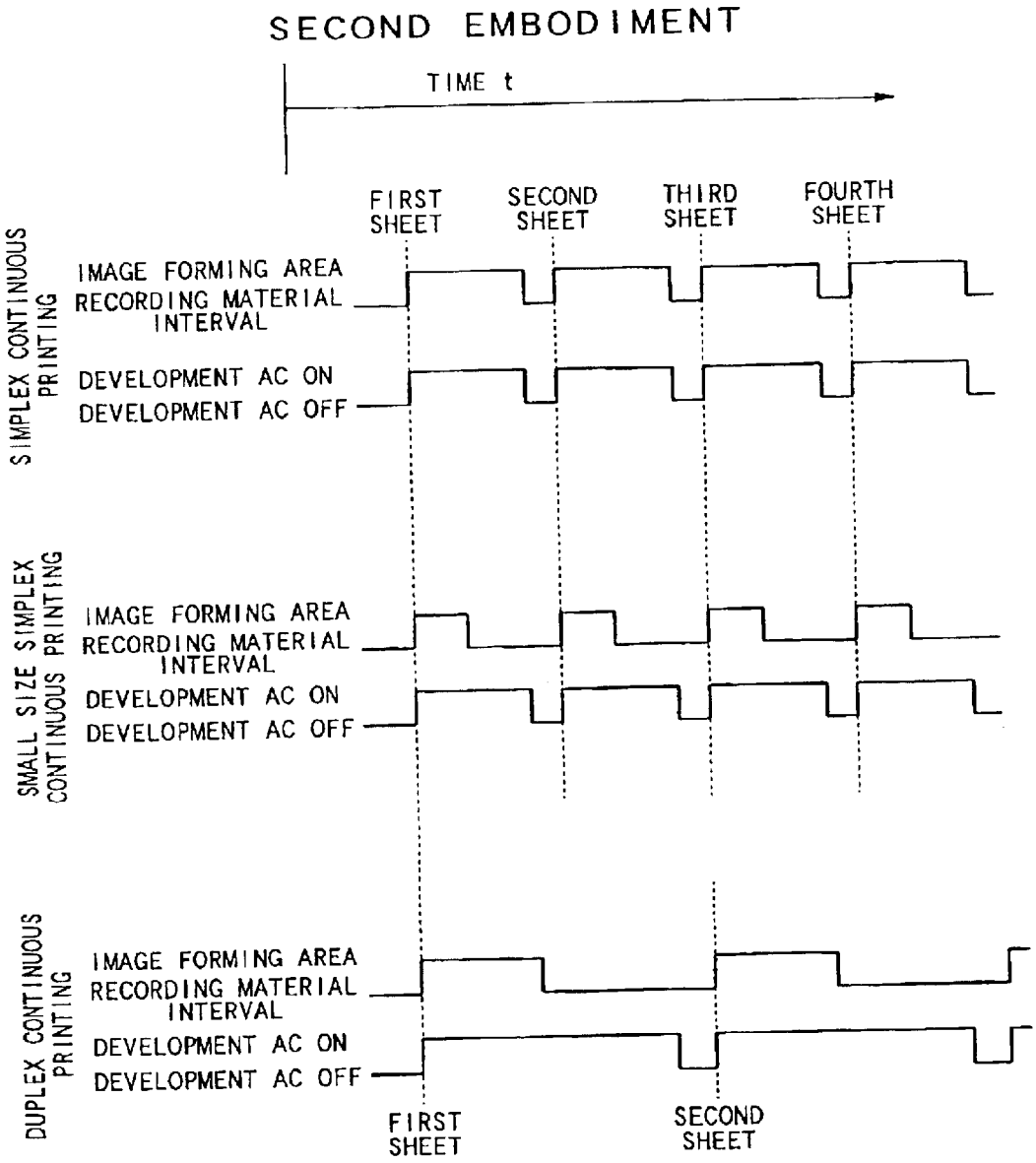
FIG. 13 shows a development bias sequence of the second embodiment.

From the above-mentioned results of examination, in this embodiment, as shown in FIG. 13, even in the case in which a recording material interval is equal to or larger than a length of one rotation of the photosensitive drum 1 (in continuous recording material passing of a recording material of every size and duplex continuous recording material passing), a development AC bias OFF time was set to be equal to or larger than a time for one rotation of the transfer member 5 and equal to or smaller than a time for one rotation of the photosensitive drum 1 before a leading edge position of the next recording material.

Figure 14:
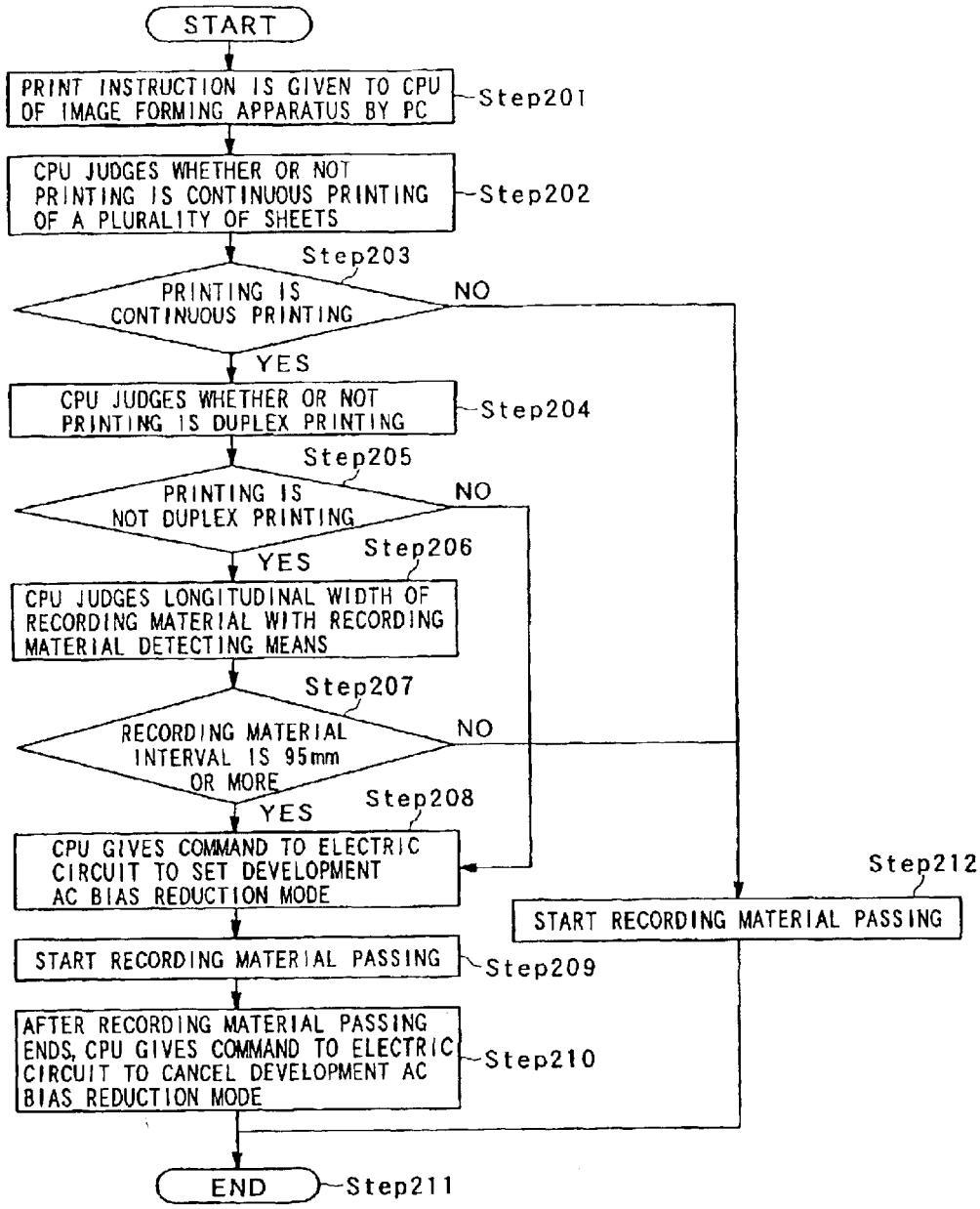
FIG. 14 is a sequence chart of the second embodiment.

A block diagram of this embodiment is also the same as that in the first embodiment. In addition, a development AC bias change sequence is substantially the same as that of the first embodiment shown in FIG. 11. However, as shown in FIG. 14, in the sequence of this embodiment, all development AC biases are not turned ON at a recording material interval as in the first embodiment. A development AC bias of a short mode, in which the development AC bias OFF time is set to be equal to or larger than the time for one rotation of the transfer member 5 and equal to or smaller than the time for one rotation of the photosensitive drum 1 (in this embodiment, when a recording material interval is assumed to be A mm, the development AC bias OFF distance is set to 60 mm in the case of $(A-95)>0$, and the development AC bias OFF distance is set to A in the case of $(A-95)<0$.

As a result, an image forming apparatus can be provided which is capable of preventing image failure caused by cleaning failure (mainly bending or chipping) inexpensively, reducing an amount of toner consumption and eliminating soiling on the back of recording material.

Third Embodiment

Figure 15:
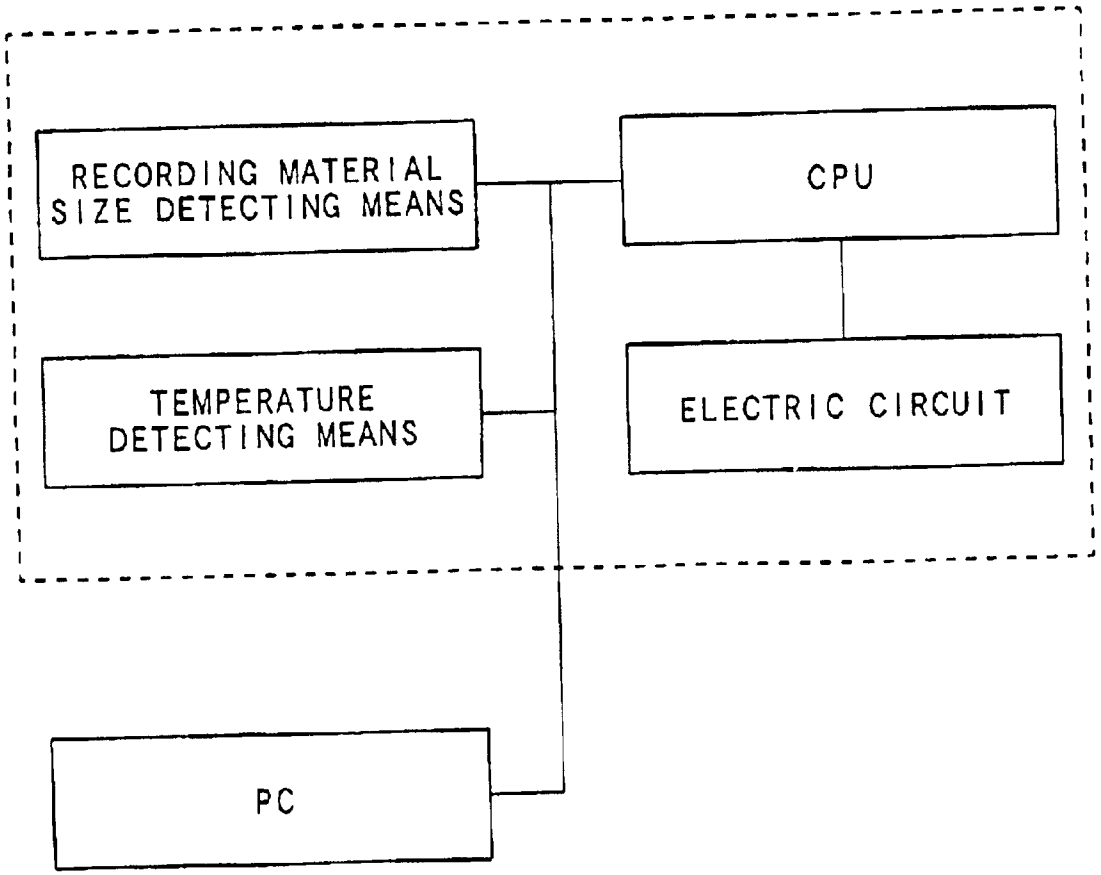
FIG. 15 is a block diagram of a third embodiment of the present invention.

A basic structure of a third embodiment is substantially the same as that of the second embodiment except that a temperature detecting means is provided in the image forming apparatus in this embodiment (see FIG. 15).

Note that, in this embodiment, the same components as described in the first and second embodiments will not be described again and will be denoted by the same reference numerals.

Since bending of the cleaning blade 61 occurs only under an environment of high temperature and high humidity, in this embodiment, the development AC bias change sequence (FIG. 13) of the second embodiment is applied only in the case in which a temperature equal to or higher than a predetermined temperature is detected by the temperature detecting means of the image forming apparatus. Under other environments in which bending of the cleaning blade 61 does not occur, the sequence of FIG. 13 is not applied. As a result, an effect of preventive measures for bending of the cleaning blade 61 can be increased with a required minimum amount of toner consumption.

Next, a block diagram for changing the development AC bias sequence of this embodiment will be described based upon FIG. 15.

First, the image forming apparatus includes a recording material size detecting means, temperature detecting means, a CPU which can acquire detection information of the detecting means and make a judgment of a recording material size, and an electric circuit which is ordered by the CPU to change the development AC bias sequence. Moreover, the CPU can acquire information on whether or not sheet passing is continuous sheet passing, whether or not sheet passing is duplex continuous sheet passing, or the like, from a PC and make a judgment.

Figure 16:
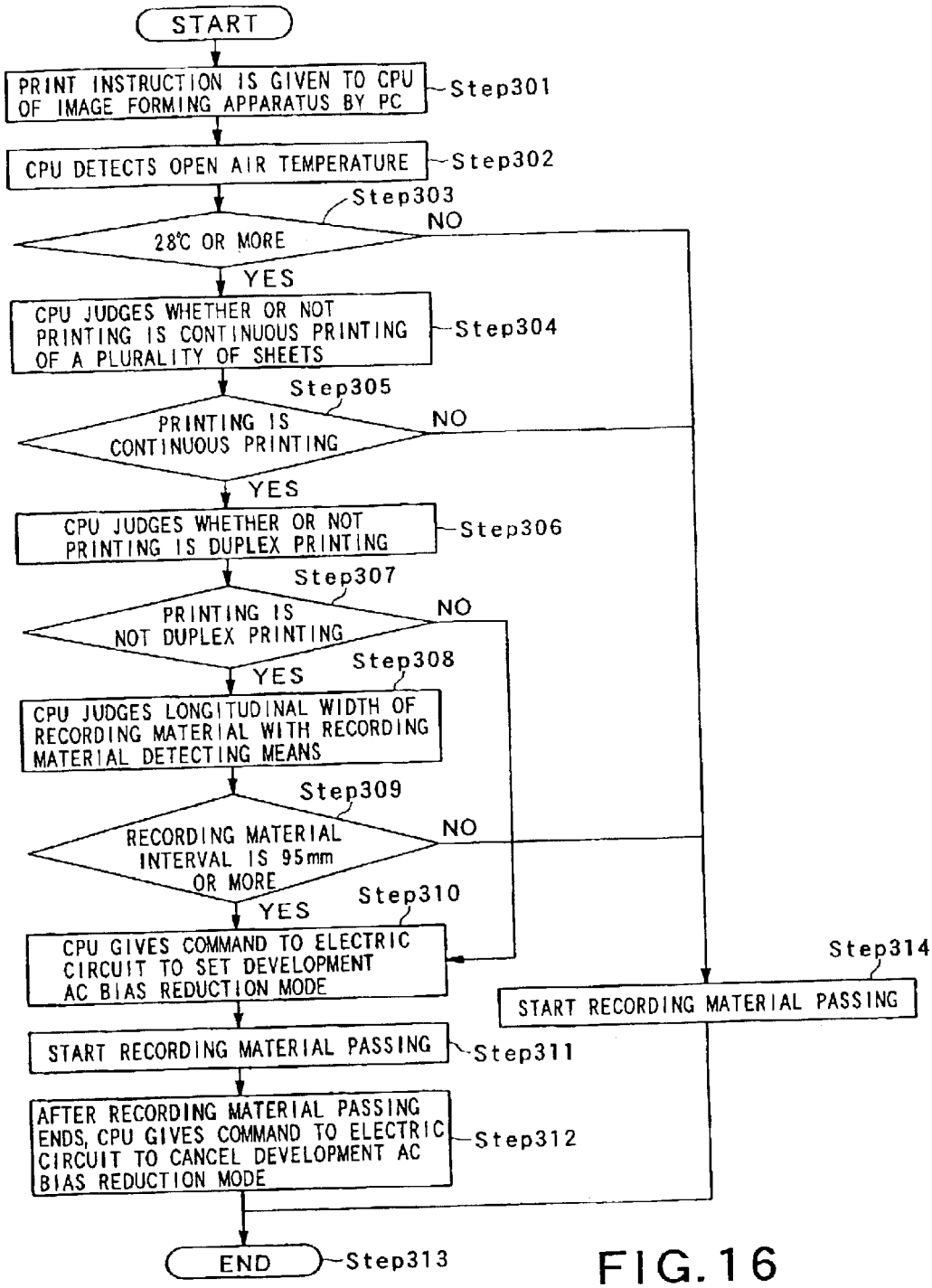
FIG. 16 is a sequence chart of the third embodiment.

Next, a development AC bias change sequence of this embodiment will be described based upon FIG. 16.

First, a print instruction is given to the CPU, which is disposed in the image forming apparatus, by the PC (step 301).

A temperature is detected by the temperature detecting means, and the CPU makes a judgment on the temperature information (step 302).

The CPU judges whether or not the detected temperature is 28° C. or higher (step 303). If the temperature is lower than 28° C., the CPU starts recording material passing (step 314), and then, ends the sequence (step S313).

If the temperature is 28° C. or higher, the CPU judges whether or not printing is continuous printing of a plurality of sheets according to information from the PC in step 304.

The CPU judges whether or not printing is continuous printing (step 305) and, if it is judged that the printing is continuous printing, the procedure proceeds to step 306. If it is judged that the printing is not continuous printing, the CPU starts recording material passing (step 314), and then, ends the sequence (step 313).

In step 306, the CPU judges whether or not the printing is duplex printing.

The CPU judges whether or not the printing is duplex printing (step 307) and, if it is judged that the printing is duplex printing, the procedure proceeds to step 310. If it is judged that the printing is not duplex printing, the procedure proceeds to step 308.

In step 308, the CPU judges a longitudinal width of recording material with the recording material size detecting means and further judges a recording material interval in the case of continuous recording material passing.

The CPU judges whether or not the recording material interval is 95 mm or more (step 309) and, when the recording material interval is less than 95 mm, the CPU starts recording material passing (step 314) and ends the sequence (step 313). On the other hand, when the recording material interval is 95 mm or more, the procedure proceeds to step 310.

In step 310, the CPU gives a command to the electric circuit to set a no development AC bias OFF mode.

In step 311, the CPU starts recording material passing.

In step 312, after the recording material passing ends, the CPU gives a command to the electric circuit to cancel the no development AC bias OFF mode.

In step 313, the CPU ends the sequence.

According to this embodiment, an image forming apparatus can be provided which is capable of preventing image failure caused by cleaning failure (mainly bending or chipping), further reducing an amount of toner consumption and eliminating soiling on the back of recording material.

Note that, in the first to third embodiments, a development AC bias is not applied-in an interval area at the time of duplex printing of a single recording material. However, since an interval area usually becomes long at the time of duplex printing regardless of the number of sheets to be printed, it may be set that an AC bias is also applied in the interval area in the case of duplex printing of a single recording material.

The present invention is not limited to the above-described examples but includes modifications within the technical thought thereof.

What is claimed is:

1. An image forming apparatus for forming an image on a recording material, comprising:

an image bearing member;

an electrostatic latent image forming means for forming an electrostatic latent image on said image bearing member;

a developing means for developing the electrostatic latent image in a development position, said developing means developing the electrostatic latent image using a developer containing a toner and an externally added agent having a charged polarity opposite to that of the toner;

a cleaning blade for cleaning said image bearing member; and a bias controlling means for controlling a bias to be applied to said developing means, wherein said bias controlling means sets a bias applied to said developing means at the time when an interval area passes the development position according to information related to a length of the interval area at the time when electrostatic latent images for a plurality of pages pass the development position.

2. An image forming apparatus according to claim 1, further comprising a transferring means for transferring a toner image, which is developed by said developing means and formed on said image bearing member, onto the recording material in a transfer position, wherein the information related to a length of the interval area is information on a length of an interval of the recording materials at the time when a plurality of the recording materials pass the transfer position.

3. An image forming apparatus according to claim 2, wherein, in the case in which an interval at the time when the plurality of recording materials pass the transfer position is shorter than a reference length, said bias controlling means sets a bias at the time when the interval area passes the development position such that the toner and the externally added agent do not adhere to said image bearing member, and in the case in which the interval at the time when the plurality of recording materials pass the transfer position is longer than the reference length, sets a bias at the time when the interval area passes the development position such that the externally added agent adheres to said image bearing member.

4. An image forming apparatus according to claim 3, wherein said bias controlling means sets a superimposed bias of a DC component and an AC component when the electrostatic latent image is developed, and in the case in which an interval at the time when the plurality of recording materials pass the transfer position is shorter than the reference length, sets the bias at the time when the interval area passes the development position to a DC bias and, in the case in which the interval at the time when the plurality of recording materials pass the transfer position is longer than the reference length, sets the bias at the time when the interval area passes the development position to the superimposed bias of the DC component and the AC component.

5. An image forming apparatus according to claim 2, further comprising a detecting means for detecting a length of an interval of the recording materials at the time when the plurality of recording materials pass the transfer position.

6. An image forming apparatus according to claim 2, wherein a length of an interval at the time when the plurality of recording materials pass the transfer position is set in advance according to sizes of the recording materials.

7. An image forming apparatus according to claim 2, wherein the reference length is a peripheral length of said image bearing member.

8. An image forming apparatus according to claim 4, wherein, in the case in which an interval at the time when the plurality of recording materials pass the transfer position is longer than the reference length, said bias controlling means sets an area to which an AC bias is not applied at the time when the interval area passes the development position.

9. An image forming apparatus according to claim 8, wherein said transferring means has a transfer member of a roller shape, and a length of the area to which an AC bias is not applied is equal to or larger than a peripheral length of said transfer member.

10. An image forming apparatus according to claim 1, wherein the information related to a length of the interval area is information on a simplex printing mode or a duplex printing mode.

11. An image forming apparatus according to claim 1, wherein a hardness of the externally added agent is higher than a hardness of a surface layer of said image bearing member.

12. An image forming apparatus according to claim 1, further comprising a temperature detecting means for detecting an environmental temperature, wherein said controlling means set a bias to be applied to said developing means at the time when the interval area passes the development position according to a detected temperature of said temperature detecting means.

* * * * *

UNITED STATES PATENT AND TRADEMARK OFFICE

CERTIFICATE OF CORRECTION

PATENT NO. : 6,804,480 B2
DATED : October 12, 2004
INVENTOR(S) : Yasunao Otomo

It is certified that error appears in the above-identified patent and that said Letters Patent is hereby corrected as shown below:

Column 1,
Line 28, “device” should read -- devices --.

Column 5,
Line 31, “melt” should read -- melted --.

Column 7,
Line 21, “harness” should read -- hardness --.

Column 11,
Line 48, “14 mm)” should read -- 14 mm). --.

Column 13,
Line 45, “applied-in” should read -- applied in --.

Signed and Sealed this

First Day of February, 2005

JON W. DUDAS
*Director of the United States Patent and Trademark Office*